US005826835A

United States Patent [19]

Wilson et al.

[11] Patent Number: 5,826,835

[45] Date of Patent: Oct. 27, 1998

[54] TOY VEHICLE SWITCH TRACK

[75] Inventors: Roy V. Wilson, Arcade, N.Y.; Donald E. Toht, Wheaton; Jeffrey H. Katz, Chicago, both of Ill.

[73] Assignee: Learning Curve International, L.L.C., Chicago, Ill.

[21] Appl. No.: 977,461

[22] Filed: Nov. 24, 1997

[51] Int. Cl.[6] ..... A63H 19/32

[52] U.S. Cl. ..... 246/415 A; 446/447

[58] Field of Search ..... 246/415 A; 238/10 E; 446/446, 447; 104/130.1

[56] References Cited

U.S. PATENT DOCUMENTS

| | | | |
|---|---|---|---|
| 2,295,358 | 9/1942 | Schaffan, Jr. | 246/415 A |
| 2,772,843 | 12/1956 | Rexford | 246/415 A |
| 4,948,073 | 8/1990 | Edwards et al. | 246/415 A |
| 5,704,822 | 1/1998 | Nilsson . | |

FOREIGN PATENT DOCUMENTS

| | | | |
|---|---|---|---|
| 1037246 | 7/1966 | United Kingdom | 246/415 A |
| WO 95/13852 | 5/1995 | WIPO . | |

OTHER PUBLICATIONS

Learning Curve Toys 1998 Wholesale Catalog, pp. 62–63.

*Primary Examiner*—S. Joseph Morano

*Attorney, Agent, or Firm*—Wallenstein & Wagner, Ltd.

[57] ABSTRACT

A toy vehicle switch track comprising a junction element having an incoming track and a plurality of outgoing tracks, a pivotable switching mechanism, an activator bar, and a guide slot. The pivotable switching mechanism is positioned at an intersection between the incoming track and the outgoing track, and guides a toy vehicle from the incoming track to one of the outgoing tracks. The activator bar has first and second ends and passes through the junction element from a first junction element edge to a second junction element edge. The activator bar engages a portion of the pivotable switching mechanism wherein the activator bar is used to alternately position the pivotable switching mechanism between the plurality of outgoing tracks. The first end and the second end each comprise a handle. The opposing handles provide an alternating resistive force against the first junction element edge and the second junction element edge to prevent over-travel of the pivotable switching element. The guide slot is recessed into the junction element and has a shape defined by a wall. The guide slot is positioned between the incoming track and the plurality of outgoing tracks. A portion of the pivotable switching mechanism traverses the guide slot.

20 Claims, 2 Drawing Sheets

TOY VEHICLE SWITCH TRACK

TECHNICAL FIELD

The present invention relates generally to toy vehicle tracks, and more particularly, the present invention relates to an apparatus for directing a toy vehicle from an incoming toy vehicle track to one of a plurality of outgoing toy vehicle tracks.

BACKGROUND

In the toy vehicle industry, small toy trains are often run on wooden tracks. These railway systems are designed to grow with the child. In other words, railway configurations can range from very simple ovals to complex systems incorporating bridges, buildings, tunnels, and towns. Many other accessories are available as well such as: toy figurines, bushes, shrubs, and trees to lend the system a realistic effect; playmats, playboards, and play tables on which to build a railway system; carry bags and boxes in which to store the railway system when not in use; and, storybooks, iron-ons, decals, and coloring books to further stimulate the child's imagination.

The railway configurations are built from individual track sections. The track sections range in size and shape. There are countless possibilities for individual track sections: some are straight; some feature switching mechanisms; some are curved; and, some are ascending for connection to another track positioned at a higher level.

An important aspect of these railway systems is that the track sections be interchangeable. Accordingly, each track section has a male connector at one end and a female connector at an opposing end. This allows the track sections to be connected end to end in a variety of configurations. Adding to the interchangeability of the track sections is the fact that these track sections are usually reversible having rails formed on both sides.

In order to impart realism to the toy railway systems, designers have sought to introduce switching mechanisms that allow one incoming track to feed two outgoing tracks. However, the switch tracks currently available do not have the requisite level of reliability.

One such switch track described in International Publication No. WO 95/13852 ("WO 95/13852"), discloses a Y-shaped toy vehicle junction element having one incoming track, two outgoing tracks, and a switching mechanism to direct toy vehicles from the incoming track to either outgoing track. This design, while overcoming some of the disadvantages of prior switch tracks, does not provide the reliability in the switching mechanism necessary to maintain its position on the junction element. The junction element described in WO 95/13852 depends on friction between an activator rod and the junction element to maintain the position of the switching mechanism on the junction element. Over time, this type of arrangement leads to wear between the activator rod and the junction element, and the switch plate's reliability is eventually lost.

In addition, the switch track disclosed in WO 95/13852 does not provide an adequate means for centering the switching element in front of one of the outgoing tracks. In WO 95/13852, the switching element is centered in front of an outgoing track when a portion of the switching element contacts a delimiting wall bored into the junction element. There is no mechanism for maintaining the position of the switching element on the junction element. In other words, the switching element of WO 95/13852 lacks reliability because as the activator rod and the junction element begin to wear, the switching element will float freely from one delimiting wall to the other. Thus, the switching element can often be positioned incorrectly on the track, and train derailments can frequently occur.

Furthermore, the device that activates the switching mechanism is only accessible from one side of the track rendering it somewhat difficult to operate because, at times, the child will need to reach across the track to activate the switching mechanism.

Also, in WO 95/13852, the device that activates the switching mechanism is joined to other elements of the switching mechanism with a notch positioned between connection ribs. Safety testing of this type of arrangement is governed by the Consumer Product Safety Commission under 16 CRF § 1500.53(e)(1)(i) which states that a toy having a projection part that a child can grasp with at least the thumb and forefinger or the teeth shall be subject to a torque test. Therefore, rigorous testing must be performed on these parts to insure compliance with standards established by ASTM F963.

Thus, the need for a junction element which provides the requisite reliability and is easy to operate exists. The present invention is provided to overcome these problems.

SUMMARY OF THE INVENTION

The toy vehicle switch track of the present invention comprises a junction element having, a pivotable switching mechanism, a guide slot, and an activator bar. The junction element has an incoming track and a plurality of outgoing tracks. The incoming and outgoing tracks are formed on the top and bottom of the switch track so that the junction element is reversible, and toy vehicles can be operated on either side.

The pivotable switching mechanism is also positioned between the incoming track and the outgoing tracks. The pivotable switching mechanism has a distal end which rotates about a pivot point to alternately position a proximate end in front of any of the outgoing tracks.

The guide slot extends from the top side of the junction element to the bottom side of the junction element. It is positioned between the incoming track and the plurality of outgoing tracks. The size and shape of the guide slot are defined by a circumferential wall. A portion of the pivotable switching mechanism is positioned within the guide slot to insure that the switching mechanism rotates properly.

The activator bar passes through the interior of the junction element and is joined to the pivotable switching mechanism. The activator bar is used to position the proximate end of the pivotable switching mechanism in front of one of the outgoing tracks. Thus, a toy vehicle can be directed from the incoming track at the distal end of the pivotable switching mechanism to one of the outgoing tracks at the proximate end of the pivotable switching mechanism.

The activator bar also serves to prevent over travel of the pivotable switching mechanism. The activator bar has a pair of opposing free ends that extend from the edges of the junction element. Each free end has a handle that is sized such that it is unable to extend into the interior of the junction element. As one handle is extended outward away from one edge of the junction element, the opposing handle is pulled inward toward the opposing junction element edge. The opposing handle cannot enter the junction element. Thus, the pivotable switching mechanism cannot be swivelled beyond the point where the opposing handle contacts the edge of the junction element.

Other advantages and aspects of the present invention will become apparent upon reading the following description of the drawings and detailed description of the invention.

DETAILED DESCRIPTION

Figure 1:
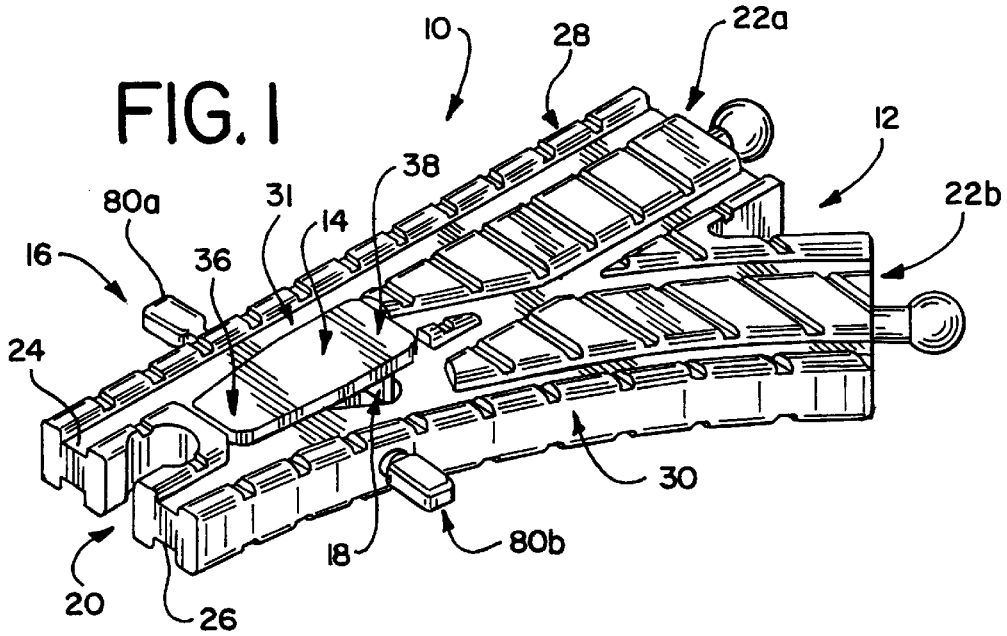
FIG. 1 is a perspective view of a toy vehicle switch track.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring to FIG. 1, a toy vehicle switch track 10 of the present invention is illustrated. The switch track 10 comprises a junction element 12 having a pivotable switching mechanism 14, an activator bar 16, and a guide slot 18. The junction element 12 has an incoming track 20 and a plurality of outgoing tracks 22*a*, 22*b*. Generally, the incoming and outgoing tracks 22*a*, 22*b* are formed on the top and bottom of the switch track 10 so that the switch track 10 is reversible, and a toy vehicle can be run on either a first side 24 or a second side 26 depending on which side is facing upward. The embodiment illustrated shows two outgoing tracks 22*a*, 22*b*. A first outgoing track follows a undeviating path along a straight edge 28. A second outgoing track follows a curved path along an arcuate edge 30. However, additional outgoing tracks 22*a*, 22*b* can be added to the junction element 12 without departing from the spirit of the invention.

Figure 2:
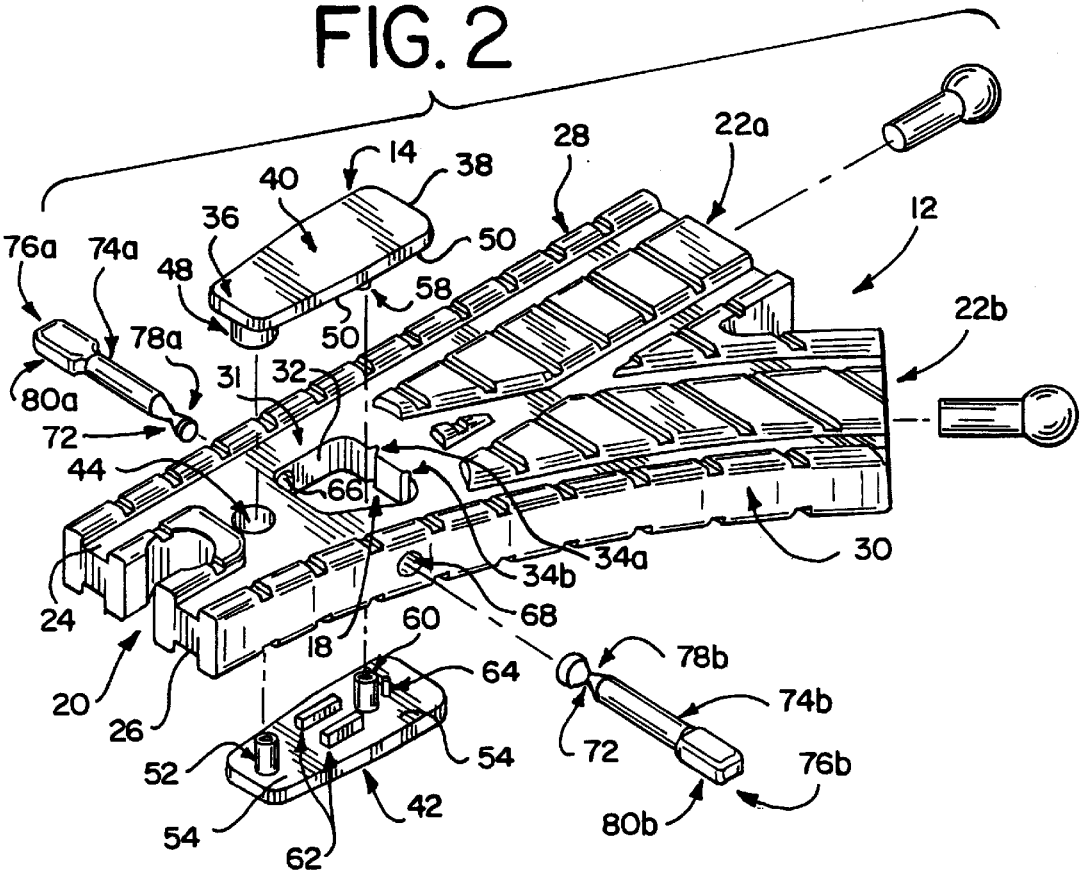
FIG. 2 is an exploded perspective view of a toy vehicle switch track.

Referring to FIG. 2, the guide slot 18 is located on the junction element 12 at an intersection 31 between the incoming track 20 and the first and second outgoing tracks 22*a*, 22*b*. In the preferred embodiment, the guide slot 18 is defined by a circumferential wall 32 that extends from the first side 24 of the junction element 12 to the second side 26 of the junction element 12.

The wall 32 includes a plurality of staging elements 34*a*, 34*b*. In the preferred embodiment, the staging elements 34*a*, 34*b* are arcuate detents milled into the wall 32 extending longitudinally from the first side 24 of the junction element 12 to the second side 26 of the junction element 12. The purpose of the staging elements 34*a*, 34*b* will become clear upon further description.

The pivotable switching mechanism 14 is positioned between the incoming track 20 and the first and second outgoing tracks 22*a*, 22*b*. One purpose of the pivotable switching mechanism 14 to guide the toy vehicle from the incoming track 20 to any one of the outgoing tracks 22*a*, 22*b* or, in the alternative, from one of the outgoing tracks 22*a*, 22*b* to the incoming track 20.

In the preferred embodiment, the pivotable switching mechanism 14 comprises a distal end 36 and a proximate end 38 and first and second switch plates 40, 42. The first switch plate 40 is positioned between the incoming track 20 and the outgoing tracks 22*a*, 22*b* on the first side 24 of the junction element 12, and the second switch plate 42 is positioned between the incoming track 20 and the outgoing tracks 22*a*, 22*b* on a second side 26 of the junction element 12.

Figure 4:
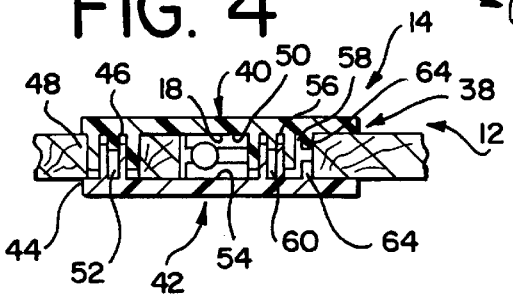
FIG. 4 is a sectional view taken along 4—4 of FIG. 3.
Figure 5:
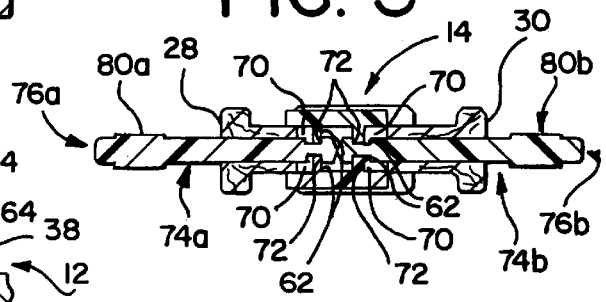
FIG. 5 is a sectional view taken along 5—5 of FIG. 3.

Referring to FIG. 4, the first and second switch plates 40, 42 are joined together at a pivot point 44 by a pivot couple 46. The pivot point 44 comprises a substantially round hole bored through the junction element 12 which allows a first female connector 48 located on an inner side 50 of the first switch plate 40 to engage a first male connector 52 located on an inner side 54 of the second switch plate 42. The first female and male connectors 48, 52 are located at the distal end 36 of the pivotable switching mechanism 14. The pivot couple 46 is formed by the union of the first female connector 48 with the first male connector 52. The first female and male connectors 48, 52 can be frictionally engaged, glued, or welded together to join the first switch plate 40 with the second switch plate 42. The pivot couple 46 allows the pivotable switching mechanism 14 to swivel about the pivot point 44, so that the proximate end 38 of the pivotable switching mechanism 14 can be selectively positioned in a co-linear fashion adjacent either the first or second outgoing tracks 22*a*, 22*b*.

Figure 3:
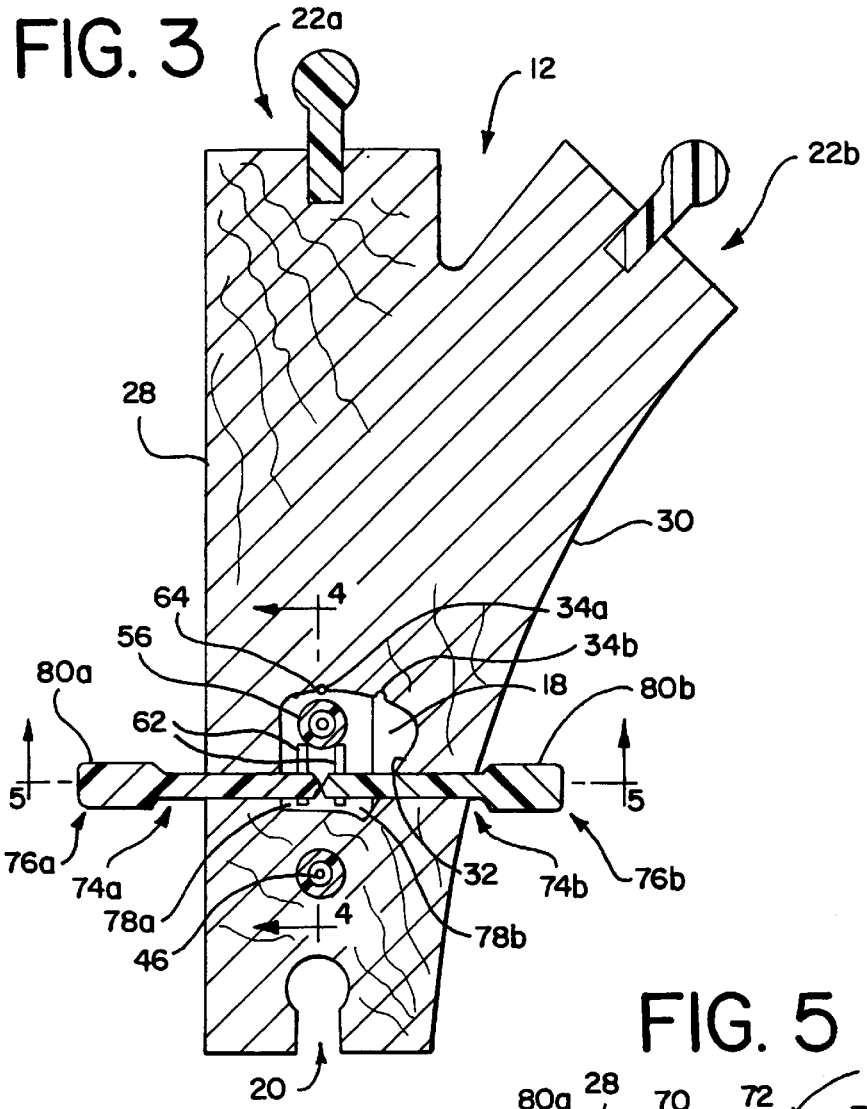
FIG. 3 is a sectional view of a toy vehicle switch track.

The first and second switch plates 40, 42 are further joined at the proximate end 38 of the pivotable switching mechanism 14 by a guide couple 56. (See FIG. 3). Referring to FIG. 4, the guide couple 56 is formed by the union of a second female connector 58 with a second male connector 60. Like the first female and male connectors 48, 52, the second female connector 58 and the second male connector 60 are located on the inner sides 50, 54 of the first and second switch plates 40, 42 respectively. The second female connector 58 passes through the guide slot 18 to frictionally engage the second male connector 60. This union of the second female connector 58 with the second male connector 60 can be achieved with friction, glue, welding, or any other method used to join two separate parts. The guide couple 56 traverses the guide slot 18 allowing the proximate end 38 of the pivotable switching mechanism 14 to be positioned in front of either the first or second outgoing tracks 22*a*, 22*b*.

Referring to FIG. 2, the pivotable switching mechanism 14 further comprises at least one connection rib 62. In the preferred embodiment, the first switch plate 40 and the second switch plate 42 comprise a plurality of connection ribs 62. The connection ribs 62 are placed in mirror image relationship on the inner sides 50, 54 of the first and second switch plates 40, 42 and between the pivot couple 46 and the guide couple 56. When the plates 40, 42 are joined, the connection ribs 62 are positioned substantially across from each other with an air gap left between them.

The pivotable switching mechanism 14 further comprises a finger 64. The finger 64 is located at the proximate end 38 of the pivotable switching mechanism 14 and extends longitudinally from the inner side 50, 54 of either the first or second switch plate 40, 42 and abuts the wall 32 so that when the pivotable switching mechanism 14 is properly positioned in front of an outgoing track, the finger 64 communicates with one of the staging elements 34*a*, 34*b* to insure that the pivotable switching mechanism 14 is locked into proper position in front of one of the outgoing tracks 22*a*, 22*b*. In an alternative embodiment, a plurality of fingers 64 are positioned at the proximate end 38 of the pivotable switching mechanism 14.

The activator bar 16 is used to alternately position the pivotable switching mechanism 14 between the plurality of outgoing tracks 22*a*, 22*b* and insure that the pivotable switching mechanism 14 does not over-travel beyond the selected outgoing track. Accordingly, the activator bar 16 is connected to the pivotable switching mechanism 14. In addition, the activator bar 16 extends from the straight edge 28 of the junction element 12 through a first pilot hole 66 to the guide slot 18 where it is joined with the pivotable switching mechanism 14. Continuing, the activator bar 16 extends through a second pilot hole 68 to the arcuate edge 30 of the junction element 12.

The activator bar 16 is joined with the pivotable switching mechanism 14 within the profile of the guide slot 18. The activator bar 16 has a V-shaped circumferential notch 70. The V-shaped circumferential notch 70 is adapted to fit over the connector ribs 62 located on the inner sides 50, 54 of the first and second switch plates 40, 42. The V-shaped circumferential notch 70 fits over a connection rib 62, and a nadir portion 72 of the circumferential notch 70 fits within the air gap between the connection ribs 62. In the preferred embodiment, the activator bar 16 includes two V-shaped circumferential notches 70.

The structure of the V-shaped circumferential notches 70 allows the activator bar 16 to circumferentially rotate. This arrangement avoids conflict with federal regulations regarding torque testing of projecting parts as outlined by the Consumer Product Safety Commission in 16 CRF § 1500.53 (e)(1)(i), and generally, meets the standards set by ASTM F963 of 4.2 lbf·in. (0.47 N·m) ASTM F963 states that torque testing can be terminated if it becomes obvious that the part will continue to rotate at less than the required torque limit and will not disassemble. The circumferential notch eliminates the need for the torque test because the activator bar 16 rotates freely without causing the component parts to disassemble.

In the preferred embodiment, the activator bar 16 comprises a pair of operating pins 74*a*, 74*b*. Each operating pin 74*a*, 74*b* has a free end 76*a*, 76*b* and a connecting end 78*a*, 78*b*. Each free end 76*a*, 76*b* comprises a handle 80*a*, 80*b*. The handles 80*a*, 80*b* are of larger cross-sectional area than the first and second pilot holes 66, 68. This structure prohibits the handles 80*a*, 80*b* from entering the first and second pilot holes 66, 68, and prevents over-travel of the pivotable switching mechanism 14. For example, as one handle 80*a* is extended outward away from the straight edge 28, the opposing handle 80*b* is pulled inward toward the opposing arcuate edge 30. The larger handle 80*b* cannot enter the smaller second pilot hole 68. Thus, the pivotable switching mechanism 14 cannot be swivelled beyond the point where the handle 80*b* contacts pilot hole.

While specific embodiments have been illustrated and. described, numerous modifications are possible without departing from the spirit of the invention, and the scope of protection is only limited by the scope of the accompanying claims.

What is claimed is:

1. A toy vehicle switch track, comprising:

a junction element having an incoming track joined at an intersection to a plurality of outgoing tracks;

a pivotable switching mechanism positioned at the intersection; and, an activator bar having a first end and a second end, the activator bar passing through the junction element from a first junction element edge to a second junction element edge and engaging a portion of the pivotable switching mechanism wherein the activator bar is used to selectively position the pivotable switching mechanism between the plurality of outgoing tracks, the first end and the second end comprising a first handle and a second handle, respectively, wherein when in a first position, the first handle engages the first junction element edge, and when in a second position, the second handle engages the second junction element edge.

2. The toy vehicle switch track of claim 1 wherein the junction element further comprises a guide slot positioned at the intersection and recessed into the junction element and having a shape defined by a wall, the wall having a plurality of staging elements one staging element associated with each outgoing track wherein a portion of the pivotable switching mechanism selectively engages the plurality of staging elements to selectively position the pivotable switching mechanism.

3. The toy vehicle switch track of claim 2 wherein each staging element comprises a recess and the pivotable switching mechanism includes a finger for selectively engaging the recesses.

4. The toy vehicle switch track of claim 1 wherein the pivotable switching mechanism includes a connection rib for engaging a portion of the activator bar.

5. The toy vehicle switch track of claim 4 wherein the activator bar has a notch to operatively engage the connection rib.

6. A toy vehicle switch track, comprising:

a junction element having an incoming track and a plurality of outgoing tracks formed on a first side and a second side, the junction element including a guide slot positioned at an intersection between the incoming track and the plurality of outgoing tracks, the guide slot passing from the first side of the junction element through to the second side of the junction element and having a shape defined by a wall;

a pivotable switching mechanism comprising a first switch plate connected to a second switch plate, the first plate positioned at the intersection on the first side of the junction element, and the second switch plate opposing the first switch plate at the intersection on the second side of the junction element;

an activator bar extending through the junction element from a first junction element edge to an opposing second junction element edge and engaging a portion of the pivotable switching mechanism wherein the activator bar is used to selectively position the pivotable switching mechanism between the plurality of outgoing tracks; and, a plurality of staging elements wherein a portion of the pivotable switch plate selectively engages the plurality of staging elements to selectively position the pivotable switch plate.

7. The toy vehicle switch track of claim 6 wherein the activator bar has a pair of operating pins, each operating pin connected to the pivotable switching mechanism and passing through a first pilot hole and a second pilot hole respectively, the first and second pilot holes defined by the first junction element edge and the second junction element edge respectively, and the first and second pilot holes passing through the junction element to the guide slot.

8. The toy vehicle switch track of claim 7 wherein each operating pin includes a handle having a cross-section larger in size than a cross-section of the first and second pilot holes wherein each handle is incapable of entering the first and second pilot holes.

9. The toy vehicle switch track of claim 6 wherein at a distal end of the switch mechanism, the first switch plate has a first male connector and the second switch plate has a first female connector, the first male and female connectors passing through the junction element at a pivot point to form a pivot couple wherein the switch mechanism is moveable about the pivot point.

10. The toy vehicle switch track of claim 9 wherein at a proximate end of the switch mechanism, the first switch plate has a second male connector and the second switch plate has a second female connector, the second male and female connectors passing through the guide slot to form a guide couple wherein the guide couple traverses the guide slot as the switch mechanism is activated.

11. The toy vehicle switch track of claim 6 wherein either the first or second switch plate includes a connection rib.

12. The toy vehicle switch track of claim 11 wherein the activator bar includes a notch for operatively engaging the connection rib whereby a portion of each operating pin is positioned between the connection rib and either the first or second switch plate.

13. The toy vehicle switch track of claim 6 wherein the first and second switch plates include a plurality of opposing connection ribs placed in mirror image relationship on the first and second switch plates, respectively.

14. The toy vehicle switch track of claim 13 wherein the activator bar includes a plurality of notches for operatively engaging the plurality of connection ribs whereby a portion of the activator bar is positioned between the connection ribs.

15. The toy vehicle switch track of claim 6 wherein the staging elements are recesses and the pivotable switching mechanism has a finger for engaging the recesses.

16. A toy vehicle switch track, comprising:

a junction element having an incoming track and a plurality of outgoing tracks formed on a first side and a second side, the junction element including a guide slot, the guide slot passing from the first side of the junction element through to the second side of the junction element and having a shape defined by a wall, the guide slot being positioned at an intersection between the incoming track and the plurality of outgoing tracks, the junction element further including a first pilot hole and a second pilot hole defined by a first junction element edge and a second junction element edge respectively and passing through the junction element to the guide slot;

a pivotable switching mechanism comprising a first switch plate connected to a second switch plate and a plurality of connection ribs, the first plate being positioned at the intersection on the first side of the junction element, and the second switch plate opposing the first switch plate and positioned at the intersection on the second side of the junction element, the plurality of opposing connection ribs placed in mirror image relationship on the first and second switch plates;

an activator bar operatively engaging a portion of the pivotable switching mechanism wherein the activator bar is used to selectively position the pivotable switching mechanism between the plurality of outgoing tracks, the activator bar having a pair of operating pins passing through the first and second pilot holes respectively and each operating pin having a free end extending from the first junction element edge and the second junction element edge respectively and a connecting end for engaging the pivotable switch plate, each connecting end including a V-shaped circumferential notch for operatively engaging the plurality of connection ribs whereby a portion of each operating pin is positioned between the connection ribs; and, a plurality of staging elements wherein a portion of the pivotable switch plate selectively engages the plurality of staging elements to selectively position the pivotable switch plate.

17. The toy vehicle switch track of claim 16 wherein each operating pin includes a handle on the free end, each handle having a cross-section larger in size than a cross-section of the first and second pilot holes wherein each handle is incapable of entering the first and second pilot holes.

18. The toy vehicle switch track of claim 16 wherein at a distal end of the switch mechanism, the first switch plate has a first male connector and the second switch plate has a first female connector, the first male and female connectors passing through the junction element at a pivot point to form a pivot couple wherein the switch mechanism is moveable about the pivot point.

19. The toy vehicle switch track of claim 18 wherein at a proximate end of the switch mechanism, the first switch plate has a second male connector and the second switch plate has a second female connector, the second male and female connectors passing through the guide slot to form a guide couple wherein the guide couple traverses the guide slot as the switch mechanism is activated.

20. The toy vehicle switch track of claim 16 wherein the staging elements are recesses and the pivotable switching mechanism has a finger for engaging the recesses.

* * * * *